US011264751B2

(12) United States Patent
Teramoto et al.

(10) Patent No.: US 11,264,751 B2
(45) Date of Patent: Mar. 1, 2022

(54) MALE CONNECTOR PROVIDED WITH HOUSING THAT ACCOMODATES MALE TERMINAL

(71) Applicant: SUMITOMO WIRING SYSTEMS, LTD., Mie (JP)

(72) Inventors: Keisuke Teramoto, Mie (JP); Hiroyuki Hiramatsu, Mie (JP); Hideki Matsunaga, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/030,293

(22) Filed: Sep. 23, 2020

(65) Prior Publication Data

US 2021/0098918 A1 Apr. 1, 2021

(30) Foreign Application Priority Data

Sep. 30, 2019 (JP) ..... JP2019-179650

(51) Int. Cl.

| | |
|---|---|
| ***H01R 13/11*** | (2006.01) |
| ***H01R 13/642*** | (2006.01) |
| ***H01R 13/04*** | (2006.01) |
| ***H01R 13/504*** | (2006.01) |
| ***H01R 13/42*** | (2006.01) |

(52) U.S. Cl.

CPC ..... *H01R 13/113* (2013.01); *H01R 13/04* (2013.01); *H01R 13/42* (2013.01); *H01R 13/5045* (2013.01); *H01R 13/642* (2013.01)

(58) Field of Classification Search

CPC ..... H01R 13/04; H01R 13/113; H01R 13/42; H01R 13/5045; H01R 13/642; H01R 13/629; H01R 13/432; H01R 13/516; H01R 43/16

See application file for complete search history.

(56) References Cited

U.S. PATENT DOCUMENTS 6,811,436 B2 11/2004 Tabata
9,281,596 B2 * 3/2016 Endo ..... H01R 13/04

* cited by examiner

*Primary Examiner* — Vanessa Girardi
(74) *Attorney, Agent, or Firm* — Abelman, Frayne & Schwab

(57) ABSTRACT

A male terminal 40 to be accommodated into a cavity 12 of a housing 11 includes a plate-like tab 49 formed in a front end part, and a box portion 41 in the form of a rectangular tube connected to a rear part of the tab 49 and open rearward. A first projection 42 projecting in a thickness direction of the tab 49 is formed on one plate surface of the tab 49, and press-fit to an inner wall of the cavity 12 of the housing 11 from behind.

7 Claims, 12 Drawing Sheets

MALE CONNECTOR PROVIDED WITH HOUSING THAT ACCOMODATES MALE TERMINAL

CROSS-REFERENCE TO RELATED APPLICATIONS

This application is based on and claims priority from Japanese Patent Application No. 2019-179650, filed on Sep. 30, 2019, with the Japan Patent Office, the disclosure of which is incorporated herein in their entireties by reference.

TECHNICAL FIELD

The present disclosure relates to a male terminal and a male connector.

BACKGROUND

Japanese Patent Laid-open Publication No. 2003-243065 describes a connector with a male terminal fitting. A cavity of the connector is provided with a receiving surface substantially orthogonal to an inserting direction of the male terminal fitting. The male terminal fitting is provided with a contact surface substantially orthogonal to the inserting direction thereof. The male terminal fitting includes a tab projecting forward from the front end of a rectangular tube portion. The contact surface is provided on the front end edge of the rectangular tube portion.

The male terminal fitting inserted into the cavity is stopped in front by the contact of the contact surface thereof with the receiving surface in the cavity substantially in the same direction as the inserting direction thereof. Thus, the male terminal fitting can be reliably stopped in front at a predetermined proper insertion position.

SUMMARY

In recent years, the miniaturization of male terminals and male connectors has been required. For the miniaturization of a male terminal, it is, for example, considered to make a metal plate material constituting the male terminal thinner than before. If the metal plate material is thinned, the metal plate material constituting a rectangular tube portion may buckle when a contact surface comes into contact with a receiving surface of a housing in the case where the contact surface is provided on the front end edge of the rectangular tube portion. Then, there is a problem that the male terminal cannot be stopped in front with respect to a male connector.

The present disclosure was completed on the basis of the above situation and aims to reliably stop a male terminal in front.

The present disclosure is directed to a male terminal to be accommodated into a cavity of a housing, the male terminal including a plate-like tab formed in a front end part, and a box portion in the form of a rectangular tube connected to a rear part of the tab and open rearward, wherein a first projection projecting in a thickness direction of the tab is formed on one plate surface of the tab, and the first projection is press-fit to an inner wall of the cavity of the housing from behind.

According to the present disclosure, the male terminal can be reliably stopped in front.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
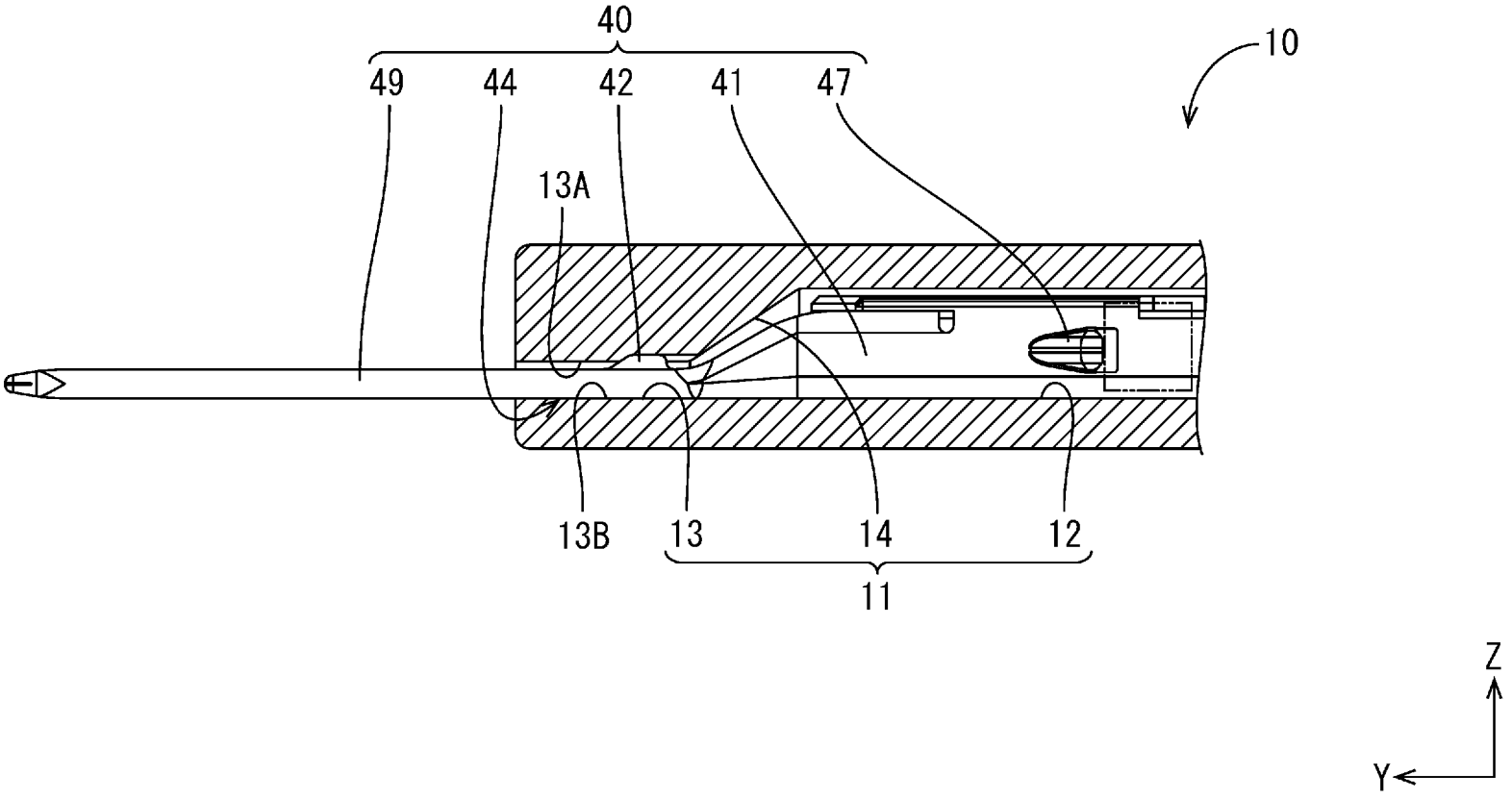
FIG. 1 is a side view in section showing a male connector according to a first embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The present disclosure is directed to a male terminal to be accommodated into a cavity of a housing, the male terminal including a plate-like tab formed in a front end part, and a box portion in the form of a rectangular tube connected to a rear part of the tab and open rearward, wherein a first projection projecting in a thickness direction of the tab is formed on one plate surface of the tab, and the first projection is press-fit to an inner wall of the cavity of the housing from behind.

The first projection is press-fit to the inner wall of the cavity from behind, whereby the male terminal is stopped in front and held in the cavity of the housing. A holding force of the male terminal in the housing can be improved as compared to the case where a metal plate is in contact with the cavity of the housing.

(2) Another plate surface of the tab preferably serves as a first positioning surface to be positioned in the thickness direction of the tab by contacting the inner wall of the cavity of the housing.

If the first projection is press-fit into the cavity of the housing, the other plate surface of the tab is pressed against the inner wall of the cavity of the housing by a reaction force from the inner wall of the cavity. At this time, the other plate surface of the tab serves as the first positioning surface and contacts the inner wall of the cavity. In this way, the relative positioning accuracy of the male terminal and a male connector can be improved in the thickness direction of the tab.

(3) Preferably, one side wall of the box portion is formed with a second projection projecting in a direction different from the first projection of the tab, and another side wall of the box portion facing the one side wall serves as a second positioning surface to be positioned in the projecting direction of the second projection by contacting the inner wall of the cavity of the housing.

According to the above configuration, the second projection is press-fit to the inner wall of the cavity, whereby the second positioning surface is pressed against the inner wall of the cavity of the housing by a reaction force from the inner wall of the cavity. In this way, the relative positioning accuracy of the male terminal and the male connector can be improved in the projecting direction of the second projection.

(4) Preferably, the second projection is formed to bulge from a metal plate material constituting the box portion, and the box portion is formed with a through hole at a position corresponding to a rear end part of the second projection.

By forming the through hole, a projecting height of the second projection from the metal plate material constituting the box portion can be made larger. In this way, the second projection is deeply press-fit to the inner wall of the cavity, wherefore the relative positioning accuracy of the male terminal and the male connector can be improved in the projecting direction of the second projection and the holding force of the male terminal in the housing can be improved.

(5) The present disclosure is directed to a male connector with any one of the above male terminals, and a housing including a cavity for accommodating the male terminal, wherein the cavity of the housing is formed with an inclined surface tapered in an extending direction of the tab and the first projection is press-fit to the inclined surface.

By press-fitting the first projection to the inclined surface from behind, the male terminal is gradually pressed against a wall surface of the inner wall of the cavity on a side opposite to the inclined surface along the inclined surface. In this way, the male terminal and the housing can be positioned in the thickness direction of the tab in the same process while the male terminal is stopped in front in the housing.

Details of Embodiments of Present Disclosure

Hereinafter, embodiments of the present disclosure are described. The present invention is not limited to these illustrations and is intended to be represented by claims and include all changes in the scope of claims and in the meaning and scope of equivalents.

First Embodiment

A first embodiment of the present disclosure is described with reference to FIGS. 1 to 10. A male connector 10 of this embodiment includes a housing 11 and a male terminal 40. In the following description of the male terminal 40, a direction indicated by an arrow Z, a direction indicated by an arrow Y and a direction indicated by an arrow X are referred to as an upward direction, a forward direction and a leftward direction in figures. Further, for a plurality of identical members, only some may be denoted by a reference sign and the others may not be denoted by the reference sign.

[Housing 11]

The housing 11 is made of insulating synthetic resin and, as shown in FIG. 1, a cavity 12 is formed to be open in a front-rear direction of the housing 11 inside the housing 11. A part of the cavity 12 formed in a front wall of the housing 11 serves as a tab insertion hole 13 open forward. The tab insertion hole 13 communicates with the cavity 12. A vertical height of the tab insertion hole 13 is smaller than that of the cavity 12.

The lower surface of the tab insertion hole 13 and that of the cavity 12 are continuous and flush with each other. In other words, no step is formed between the lower surface of the tab insertion hole 13 and that of the cavity 12.

The rear surface of the front wall of the housing 11 is formed with an inclined surface 14 coupling an upper wall of the cavity 12 and an upper wall 13A of the tab insertion hole 13. The rear surface of the front wall of the cavity 12 is tapered in the forward direction (extending direction of the tab insertion hole 13), whereby the inclined surface 14 is inclined obliquely downward toward the front.

Figure 2:
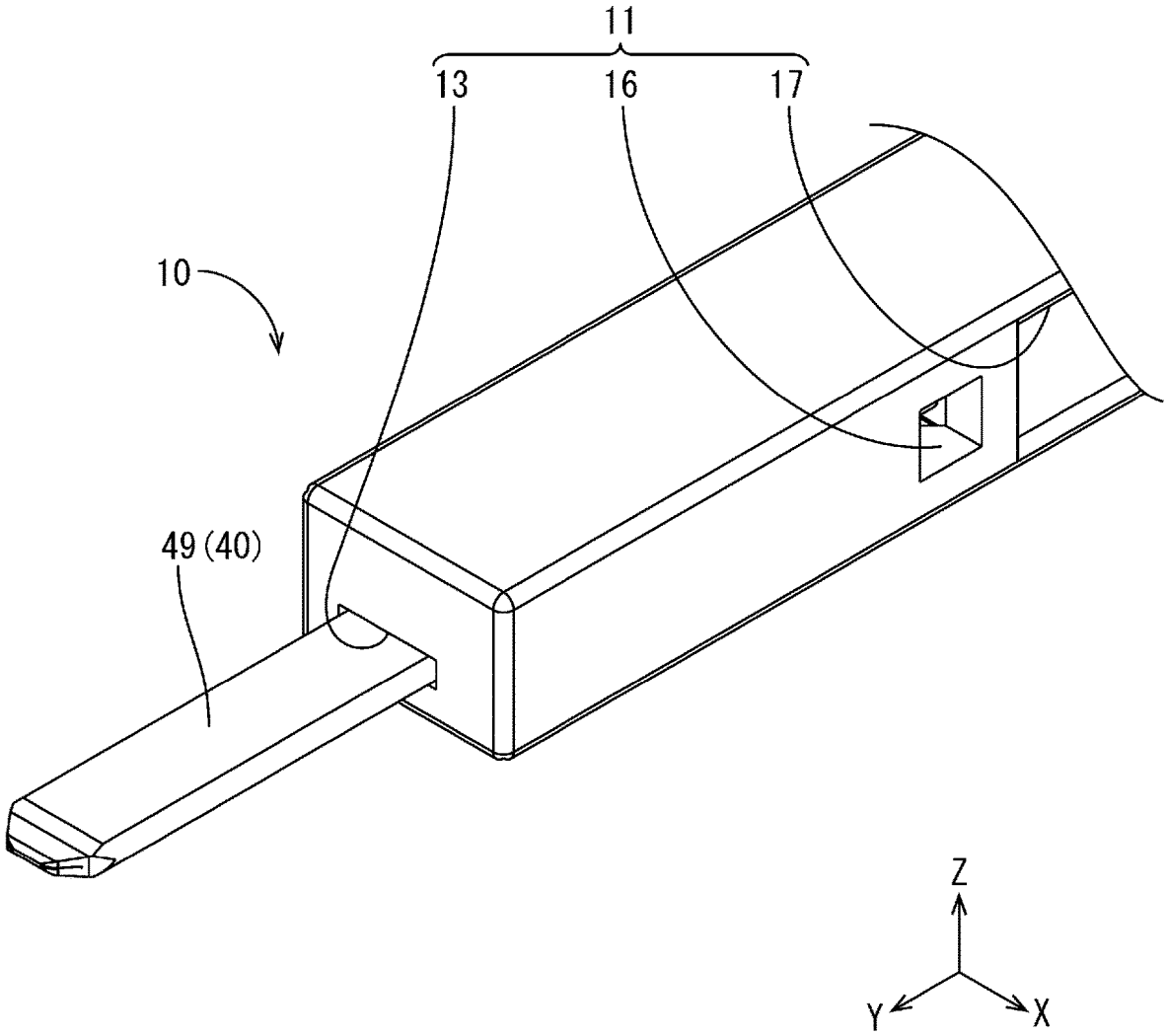
FIG. 2 is a partial enlarged perspective view showing the male connector.
Figure 3:
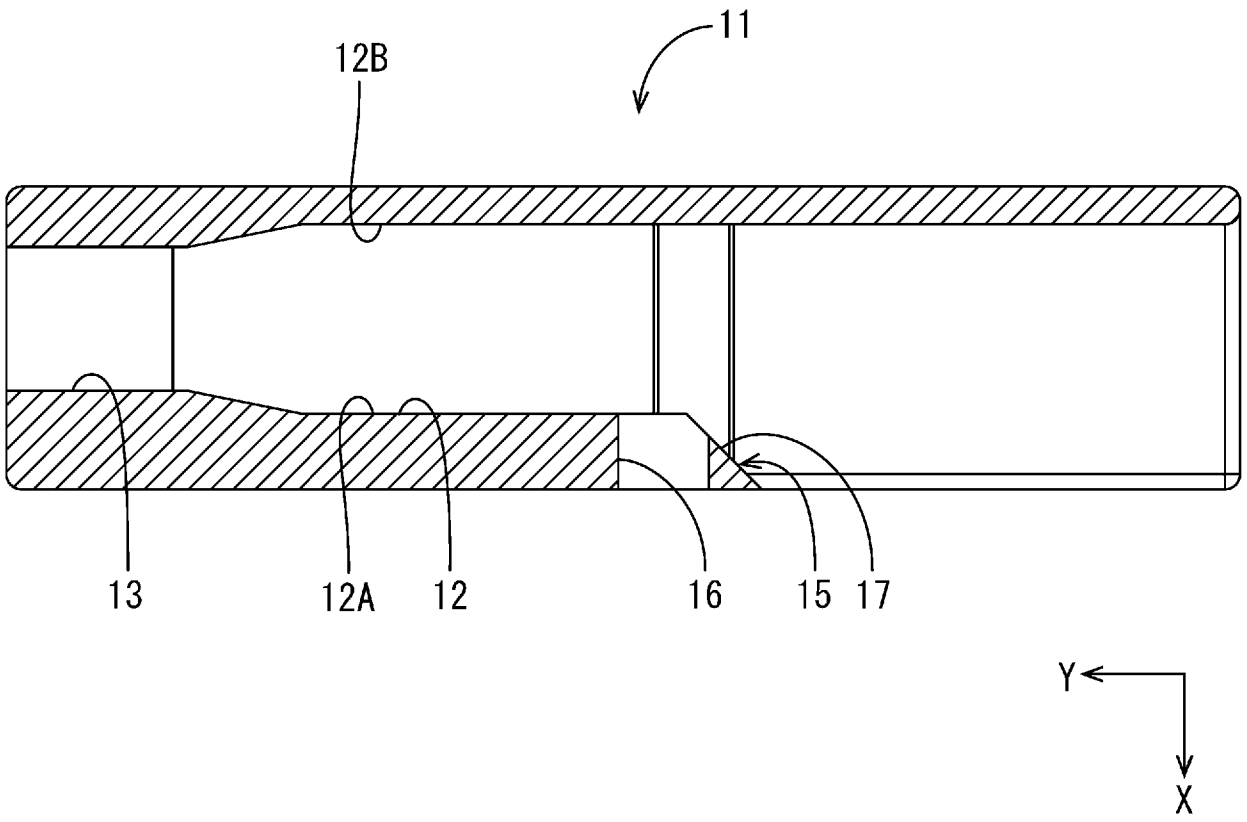
FIG. 3 is a plan view in section showing a housing.

As shown in FIGS. 2 and 3, the housing 11 is formed with a front opening 16 open leftward and communicating with the cavity 12. Further, the housing 11 is formed with a rear opening 17 open leftward and communicating with the cavity 12 behind the front opening 16.

As shown in FIG. 3, a guiding slope 15 inclined obliquely rearward toward the left is formed from a rear end part of the front opening 16 to a front end part of the rear opening 17. This guiding slope 15 and a second projection 47 to be described later slide in contact with each other.

[Male Terminal 40]

Figure 4:
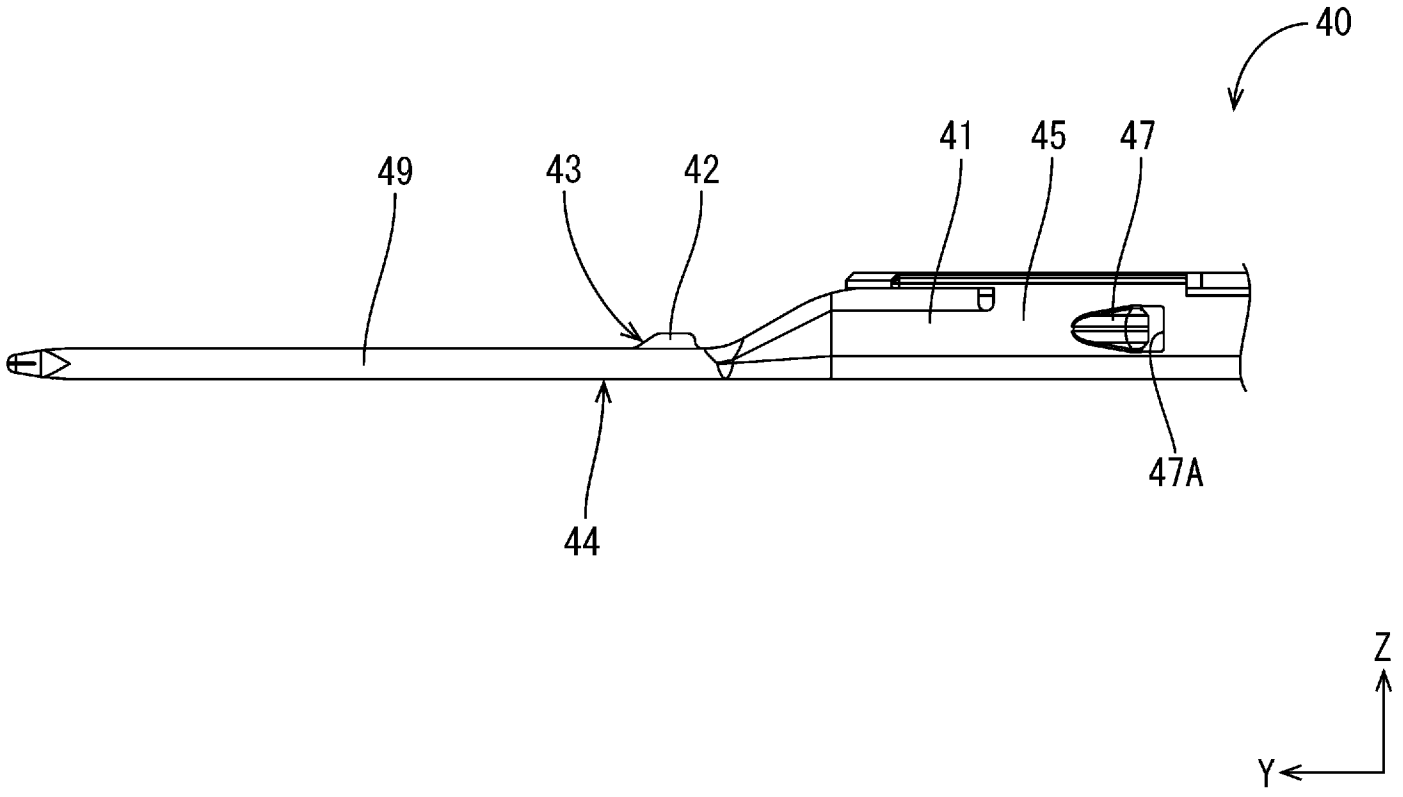
FIG. 4 is a side view showing a male terminal.

As shown in FIG. 4, the male terminal 40 is formed by bending a metal plate material stamped into a predetermined shape, and elongated in the front-rear direction as a whole. An arbitrary metal such as copper, copper alloy, aluminum or aluminum alloy can be selected as the metal plate material.

Figure 5:
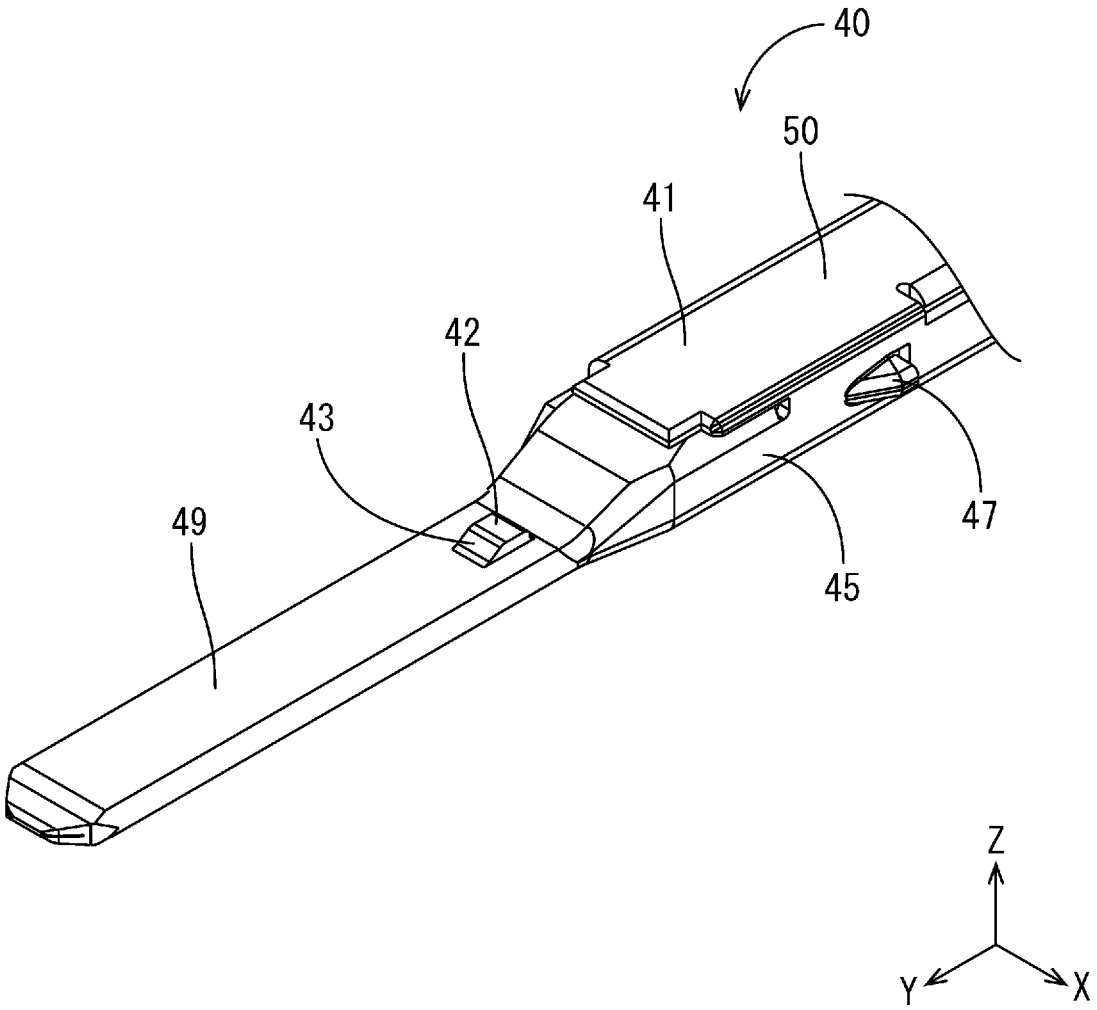
FIG. 5 is a partial enlarged perspective view showing the male terminal.
Figure 6:
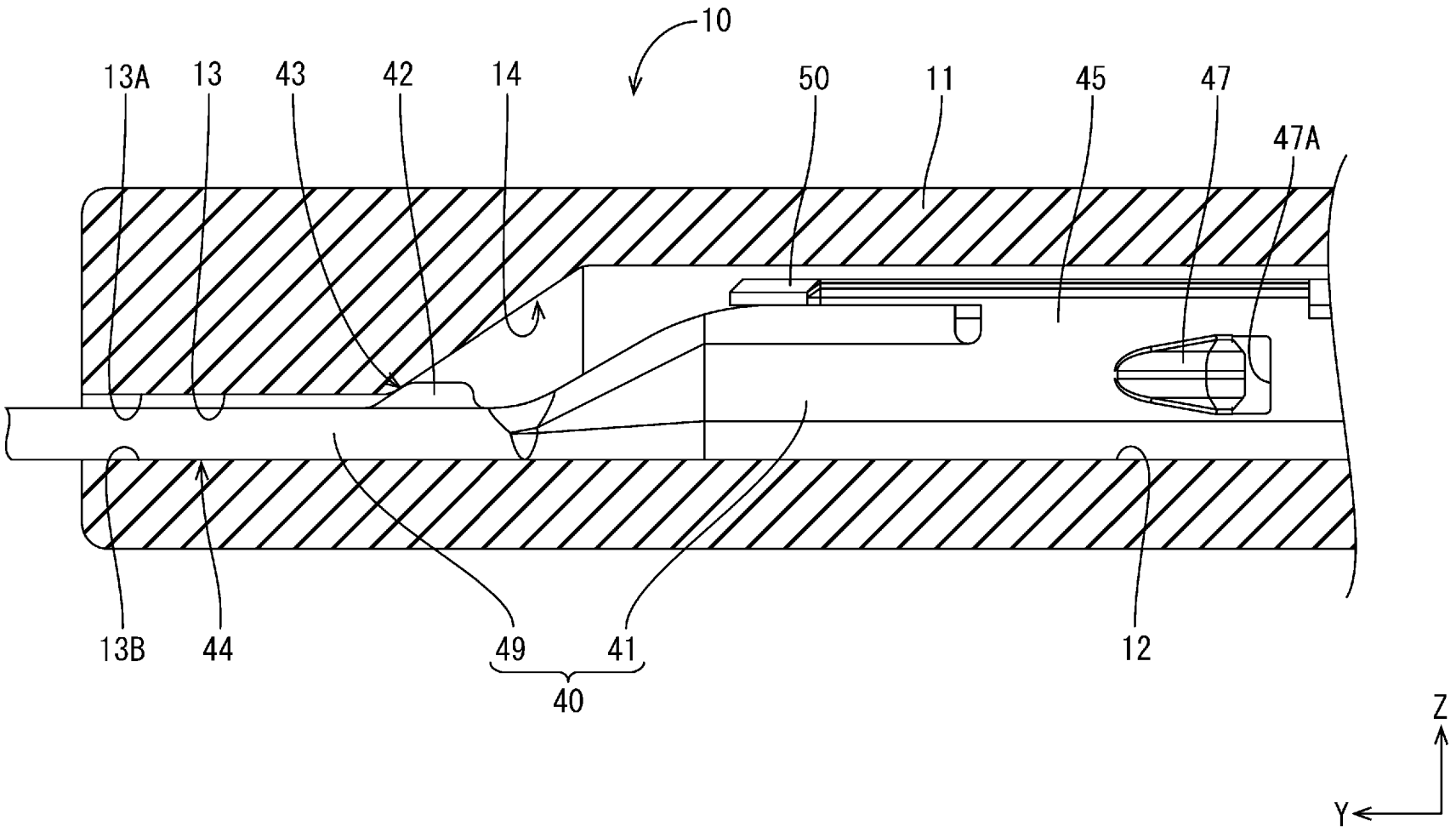
FIG. 6 is a partial enlarged side view in section showing a state before a first projection is inserted into a tab insertion hole.

As shown in FIG. 5, a tab 49 elongated forward is formed in a front end part of the male terminal 40. The tab 49 is connected to an unillustrated mating female terminal. A first projection 42 projecting upward is formed at a position near a rear end part on the upper surface of the tab 49. The first projection 42 is formed near a lateral center of the tab 49. The first projection 42 is formed by striking the metal plate material constituting the tab 49. As shown in FIG. 6, the front surface of the first projection 42 serves as a front slope 43 inclined downward toward the front. An angle of inclination of the front slope 43 and that of the inclined surface 14 of the cavity 12 are set substantially equal.

As shown in FIG. 6, the vertical height of the tab insertion hole 13 of the housing 11 is larger than that of a part of the tab 49 different from a part where the first projection 42 is provided. On the other hand, the sum of the heights of the tab 49 and the first projection 42 is set larger than the vertical height of the tab insertion hole 13. In this way, the first projection 42 is press-fit to the upper wall 13A of the tab insertion hole 13 with the tab 49 inserted in the tab insertion hole 13. When the first projection 42 is press-fit to the upper wall 13A of the tab insertion hole 13, the lower surface of the tab is pressed against a lower wall 13B of the tab insertion hole 13 from above. In this way, the tab 49 is positioned in a vertical direction with respect to the housing 11. The lower surface of the tab 49 serves as a first positioning surface 44. The upper wall 13A and the lower wall 13B of the tab insertion hole 13 are facing each other.

As shown in FIG. 4, a substantially central part in a length direction of the male terminal 40 serves as a box portion 41. The box portion 41 extends in the front-rear direction and is in the form of a rectangular tube flat in the vertical direction as a whole. The front surface of the box portion 41 is closed by a front wall. The box portion 41 includes a bottom wall, a left side wall 46 and a right side wall 46 extending upward from both left and right side edges of the bottom wall and an upper wall 50 bent from an upper end part of one of the left and right side walls 45, 46 and locked to an upper end part of the other.

Figure 7:
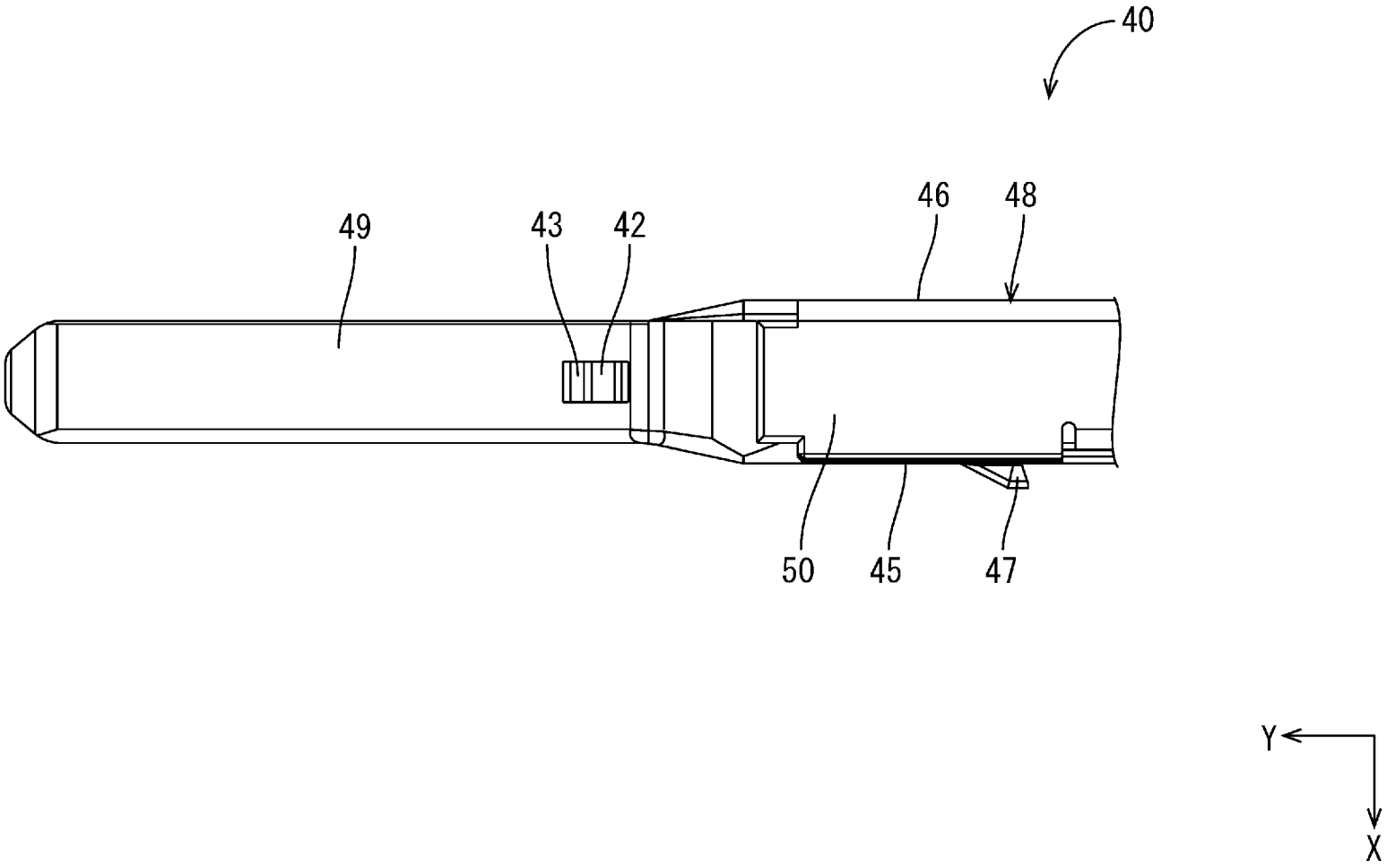
FIG. 7 is a plan view showing the male terminal.

As shown in FIG. 7, a lateral width of the box portion 41 is set somewhat larger than that of the tab 49. In this way, the left and right side walls 45, 46 of the box portion 41 somewhat bulge from the tab 49 in a lateral direction.

As shown in FIG. 7, the second projection 47 projecting leftward is formed at a position near a rear end part of the left side wall 45 of the box portion 41. The second projection 47 is formed by striking the metal plate material constituting the left side wall 45. The front surface of the second projection 47 is inclined obliquely rearward toward the left. In this way, the front surface of the second projection 47 smoothly slides in contact with the guiding slope 15 of the housing 11. The rear surface of the second projection 47 is formed to be steep and overhang. In this way, the second projection 47 press-fit to a left side wall 12A of the cavity 12 is prevented from coming out rearward.

The box portion 41 is formed with a through hole 47A penetrating through the left side wall 45 of the box portion 41 at a position corresponding to a rear end part of the second projection 47. The through hole 47A is open up to a position somewhat behind the rear end part of the second projection 47.

Figure 10:
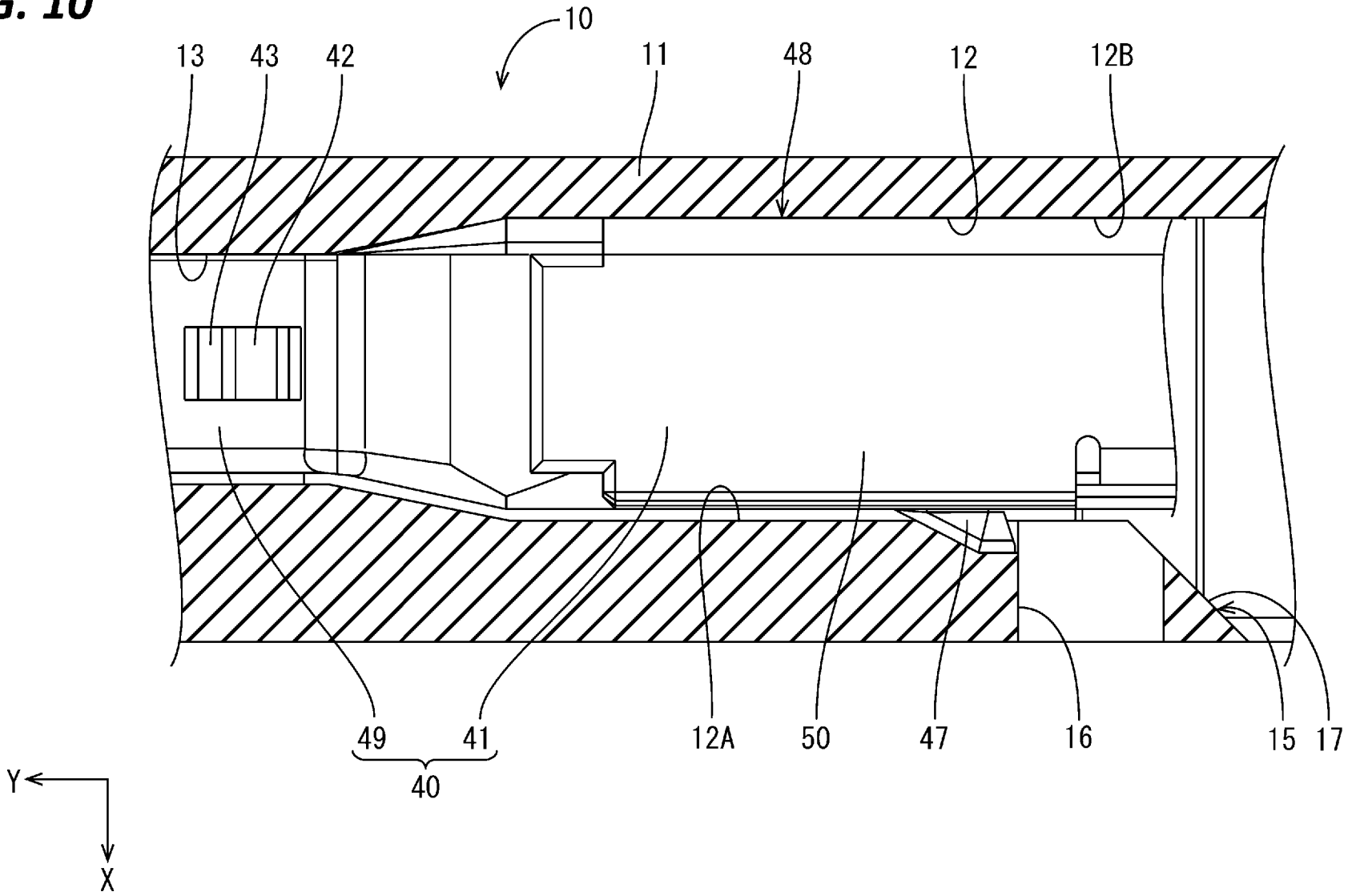
FIG. 10 is a partial enlarged side view in section showing the male connector.

As shown in FIG. 10, a lateral width of the cavity 12 is set smaller than the sum of widths of the box portion 41 and the second projection 47. In this way, the second projection 47 can be press-fit to the left side wall 12A of the cavity 12 with the box portion 41 accommodated in the cavity 12. With the second projection 47 press-fit to the left side wall 12A of the cavity 12, the right side surface of the box portion 41 is pressed against a right side wall 12B of the cavity 12 from left. In this way, the box portion 41 is positioned in the lateral direction with respect to the housing 11. The right side surface of the box portion 41 serves as a second positioning surface 48.

Although not shown in detail, a wire connecting portion to which a wire is to be connected is provided on the rear end of the box portion 41. A connecting structure of the wire and the wire connecting portion is not particularly limited and an arbitrary method such as crimping, insulation displacement, soldering or welding can be used.

[Assembly Process of Male Connector 10]

Next, an example of an assembly process of the male connector 10 is described. The assembly process of the male connector 10 is not limited to that described below.

The male terminal 40 is inserted into the cavity 12 of the housing 11 from behind and the front end part of the tab 49 reaches the tab insertion hole 13.

The front end part of the tab 49 is inserted into the tab insertion hole 13 from behind. If the male terminal 40 is further pushed forward, the first projection 42 of the tab 49 comes into contact with the inclined surface 14 of the housing 11 from behind as shown in FIG. 6. Since the angle of inclination of the front slope 43 of the first projection 42 and that of the inclined surface 14 of the housing 11 are substantially equal, the first projection 42 is smoothly guided by the inclined surface 14 and reaches a rear end part of the tab insertion hole 13.

Figure 9:
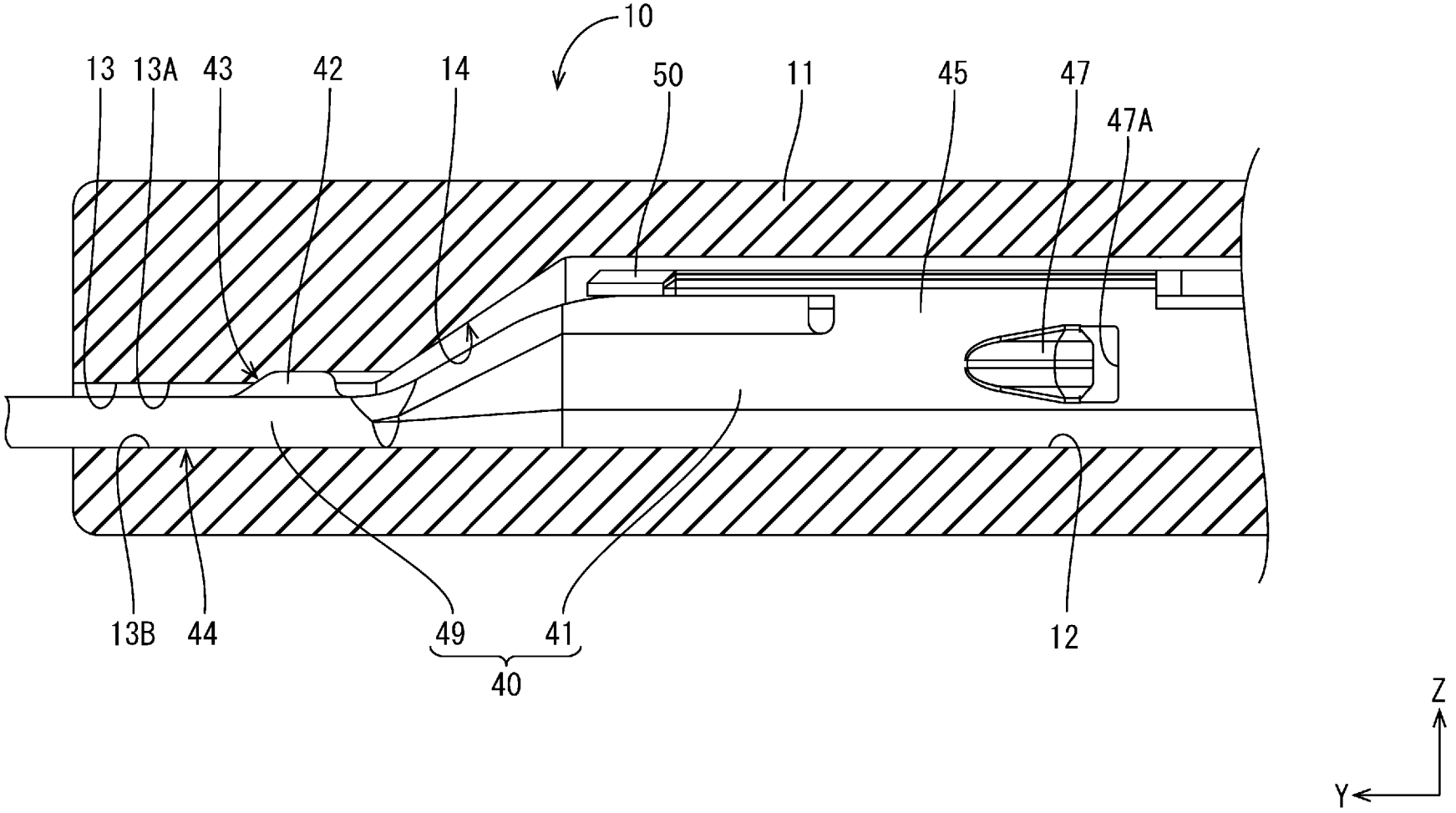
FIG. 9 is a partial enlarged side view in section showing the male connector.

If the male terminal 40 is pushed further forward, the first projection 42 is press-fit to the upper wall 13A of the tab insertion hole 13 as shown in FIG. 9. Then, the male terminal 40 is pushed down by a reaction force and the first positioning surface 44 of the tab 49 is pressed against the lower wall 13B of the tab insertion hole 13 from above. The male terminal 40 is further pushed forward and held in a front stop state.

Figure 8:
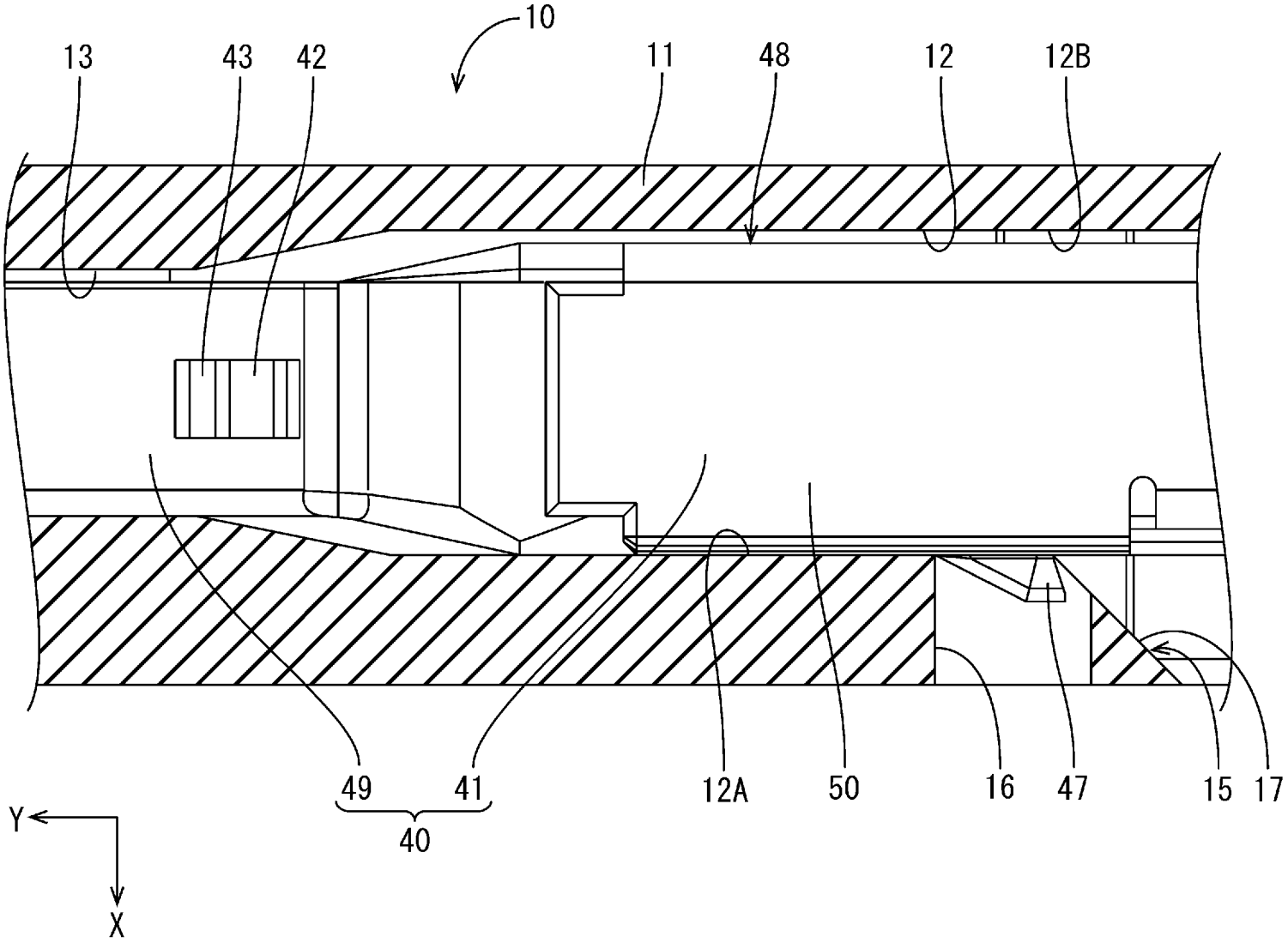
FIG. 8 is a partial enlarged plan view in section showing the state before the first projection is inserted into the tab insertion hole.

On the other hand, the second projection 47 is guided into the front opening 16 as shown in FIG. 8 by sliding in contact with the guiding slope 15 of the housing 11. In the front opening 16, the second projection 47 is not in contact with the housing 11.

If the male terminal 40 is pushed further forward, the second projection 47 is press-fit to the left side wall 12A of the cavity 12 as shown in FIG. 10. Then, the box portion 41 is pushed rightward by a reaction force and the second positioning surface 48 of the box portion 41 is pressed against the right side wall 12B of the cavity 12 from left. In this way, the male terminal 40 is held in a rear stop state in the cavity 12.

Next, functions and effects of this embodiment are described. This embodiment relates to the male terminal 40 to be accommodated into the cavity 12 of the housing 11, the male terminal 40 includes the plate-like tab 49 formed in the front end part and the box portion 41 in the form of a rectangular tube connected to a rear part of the tab 49 and open rearward, the first projection 42 projecting in a thickness direction of the tab 49 is formed on one plate surface of the tab 49, and the first projection 42 is press-fit to the upper wall 13A of the tab insertion hole 13, out of the cavity 12 of the housing 11, from behind.

The first projection 42 is press-fit to the upper wall 13A of the tab insertion hole 13, out of the cavity 12, from behind, whereby the male terminal 40 is held in the front stop state in the cavity 12 of the housing 11. A holding force of the male terminal 40 in the housing 11 can be improved as compared to the case where a metal plate is in contact with the cavity 12 of the housing 11.

Further, according to this embodiment, the other plate surface of the tab 49 serves as the first positioning surface 44 to be positioned in the thickness direction of the tab 49 by contacting the lower wall 13B of the tab insertion hole 13, out of the cavity 12 of the housing 11.

If the first projection 42 is press-fit into the cavity 12 of the housing 11, the other plate surface of the tab 49 is pressed against the lower wall 13B of the tab insertion hole 13, out of the cavity 12 of the housing 11, by a reaction force from the upper wall 13A of the tab insertion hole 13, out of the cavity 12. At this time, the other plate surface of the tab 49 serves as the first positioning surface 44 and contacts the lower wall 13B of the tab insertion hole 13, out of the cavity 12. In this way, the relative positioning accuracy of the male terminal 40 and the male connector 10 can be improved in the thickness direction of the tab 49.

Further, according to this embodiment, one side wall of the box portion 41 is formed with the second projection 47 projecting in a direction different from the first projection 42 of the tab 49, and the other side wall of the box portion 41 facing the one side wall serves as the second positioning surface 48 to be positioned in the projecting direction of the second projection 47 by contacting the right side wall 12B of the cavity 12 of the housing 11.

According to the above configuration, the second projection 47 is press-fit to the left side wall 12A of the cavity 12, whereby the second positioning surface 48 is pressed against the right side wall 12B of the cavity 12 of the housing 11 by a reaction force from the left side wall 12A of the cavity 12. In this way, the relative positioning accuracy of the male terminal 40 and the male connector 10 can be improved in the projecting direction of the second projection 47.

Further, according to this embodiment, the second projection 47 is shaped to bulge from the metal plate material constituting the box portion 41, and the box portion 41 is formed with the through hole 47A at the position corresponding to the rear end part of the second projection 47.

By forming the through hole 47A, a projecting height of the second projection 47 from the metal plate material constituting the box portion 41 can be made larger. Since the second projection 47 is deeply press-fit to the left side wall 12A of the cavity 12 in this way, the relative positioning accuracy of the male terminal 40 and the male connector 10 can be improved in the projecting direction of the second projection 47 and the holding force of the male terminal 40 in the housing 11 can be improved.

Further, this embodiment relates to the male connector 10 with the male terminal 40 and the housing 11 including the cavity 12 for accommodating the male terminal 40, the cavity 12 of the housing 11 is formed with the inclined surface 14 tapered in the extending direction of the tab 49, and the first projection 42 is press-fit to the inclined surface 14.

By press-fitting the first projection 42 to the inclined surface 14 from behind, the male terminal 40 is gradually pressed against a wall surface of the inner wall of the cavity 12 on a side opposite to the inclined surface 14 along the inclined surface 14. In this way, the male terminal 40 and the housing 11 can be positioned in the thickness direction of the tab 49 in the same process while the male terminal 40 is stopped in front in the housing 11.

Second Embodiment

Next, a second embodiment of the present disclosure is described with reference to FIGS. 11 and 12. In a male terminal 70 according to this embodiment, a right side surface 71A of a tab 71 and a right side surface 72A of a box portion 72 are continuous and flush with each other. In other words, no step is formed between the right side surface 71A of the tab 71 and the right side surface 72A of the box portion 72.

Figure 11:
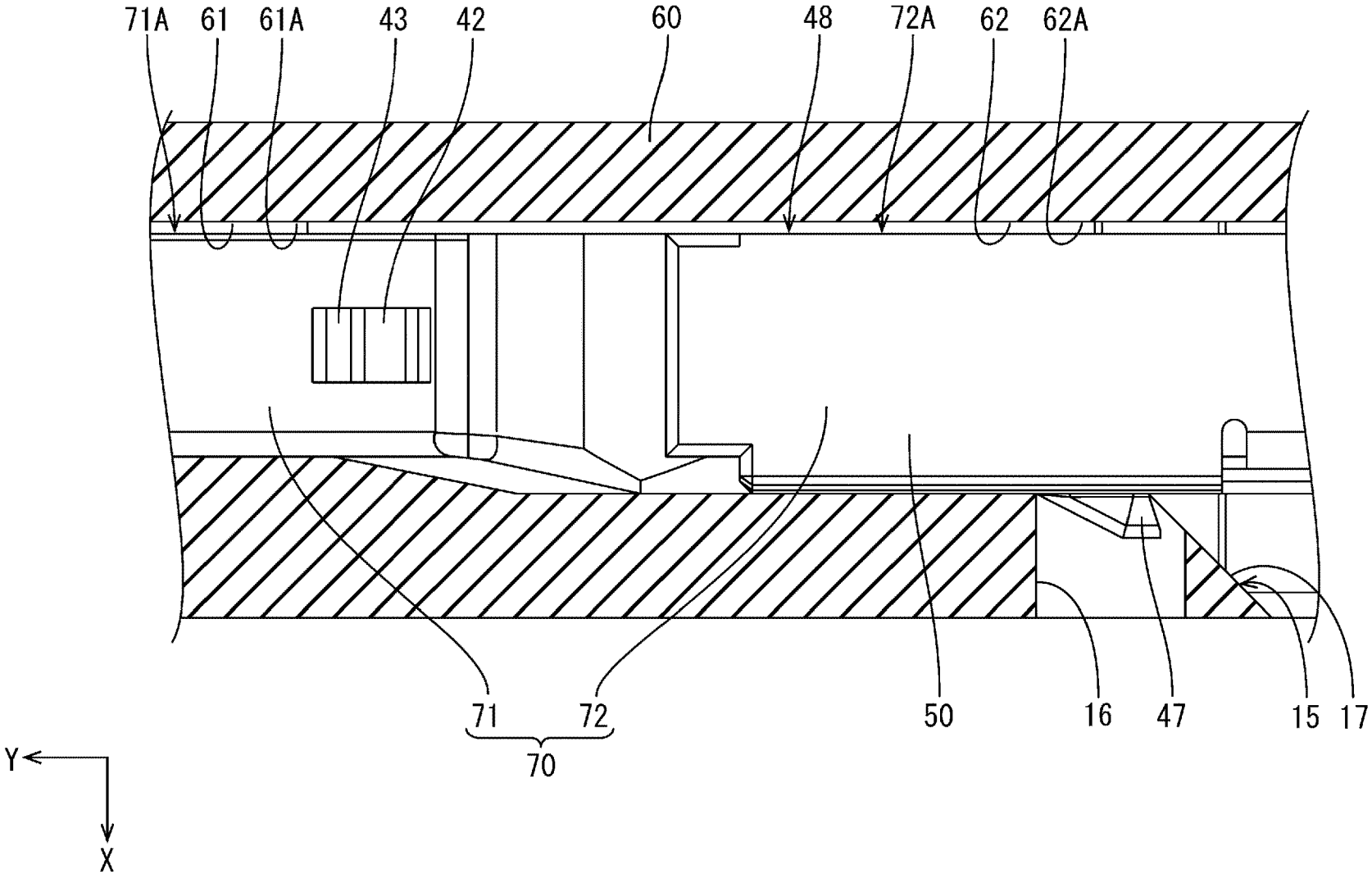
FIG. 11 is a partial enlarged plan view in section of a male connector according to a second embodiment showing a state before a tab is inserted into a tab insertion hole.

As shown in FIG. 11, in a housing 60 according to this embodiment, a right side wall 61A of a tab insertion hole 61 and a right side wall 62A of a cavity 62 are continuous and flush with each other. In other words, no step is formed between the right side wall 61A of the tab insertion hole 61 and the right side wall 62A of the cavity 62.

Since the configuration other than the above is substantially the same as in the first embodiment, the same members are denoted by the same reference signs and repeated description is omitted.

Figure 12:
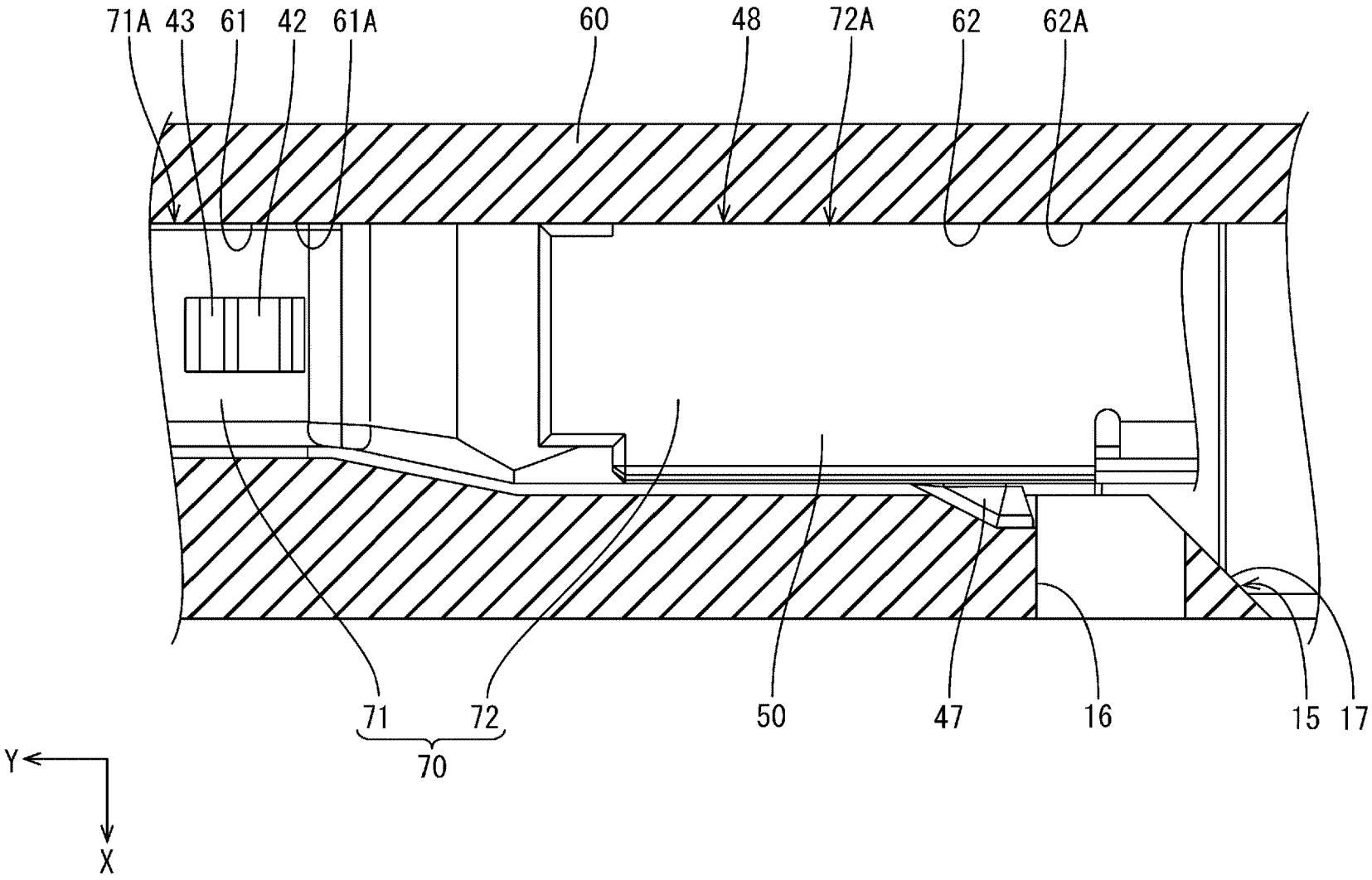
FIG. 12 is a partial enlarged plan view in section showing the male connector.

As shown in FIG. 12, with the male terminal 70 inserted in the cavity 62 of the housing 60, the right side surface 71A of the tab 71 is pressed against the right side wall 61A of the tab insertion hole 61 from left and the right side surface 72A of the box portion 72 is pressed against the right side wall 62A of the cavity 62 from left. In this way, the tab 71 and the box portion 72 are integrated to form a flat surface for positioning extending in the front-rear direction in the male terminal 70, and the tab insertion hole 61 and the cavity 62 are integrated to form a flat surface for positioning extending in the front-rear direction in the housing 60. As a result, the positioning accuracy of the male terminal 70 in the lateral direction can be improved in the cavity 62.

Other Embodiments (1) A plurality of the male terminals 40 may be accommodated in one male connector 10.

(2) The first projection 42 may be formed on the lower surface of the tab 49. In this case, the first positioning surface 44 is provided on the upper surface of the tab 49.

(3) The second projection 47 may be formed on the right side wall of the box portion 41. In this case, the second positioning surface 48 is provided on the left side wall 45 of the box portion 41.

(4) The second projection 47 may be omitted and the male terminal 40 may be locked in the housing 11 by a locking lance provided to project into the cavity 12 from the inner wall of the cavity 12.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A male terminal to be accommodated into a cavity of a housing, comprising:

a plate-like tab formed at a front end part of the male terminal; and a box portion having a rectangular tube shape, connected to a rear part of the tab and open rearward, wherein:

a first projection projecting in a thickness direction of the tab is formed on one plate surface of the tab, the first projection includes a front slope that is inclined downward from a top surface of the first projection in a direction in which the male terminal is accommodated into the cavity of the housing, and the first projection is press-fit to an inner wall of the cavity of the housing through the front slope from behind of the housing.

2. The male terminal of claim 1, wherein another plate surface of the tab serves as a first positioning surface to be positioned in the thickness direction of the tab by contacting the inner wall of the cavity of the housing.

3. The male terminal of claim 1, wherein the first projection is formed by striking a metal plate material constituting the plate-like tab.

4. The male terminal of claim 1, wherein:

one side wall of the box portion is provided with a second projection projecting in a direction different from the first projection of the tab, and another side wall of the box portion facing the one side wall serves as a second positioning surface to be positioned in the direction in which the second projection projects by contacting the inner wall of the cavity of the housing.

5. The male terminal of claim 4, wherein the second projection is formed to bulge from a metal plate material constituting the box portion, and the box portion is provided with a through hole at a position corresponding to a rear end part of the second projection.

6. A male connector, comprising:

a male terminal comprising a plate-like tab formed at a front end part; and a box portion having a rectangular tube shape, connected to a rear part of the tab, and open rearward, a housing including a cavity configured to accommodate the male terminal, wherein:

a first projection projecting in a thickness direction of the tab is formed on one plate surface of the tab, and including a front slope that is inclined downward from a top surface of the first projection in a direction in which the male terminal is accommodated into the cavity of the housing, the first projection is press-fit to an inner wall of the cavity of the housing through the front slope from behind of the housing, and the cavity of the housing is provided with an inclined surface tapered with respect to an extending direction of the tab and the first projection is press-fit to the inclined surface.

7. The male connector of claim 6, wherein the first projection is formed by striking a metal plate material constituting the plate-like tab.

* * * * *